United States Patent [19]

Stull

[11] 4,298,129

[45] Nov. 3, 1981

[54] CHILDPROOF, SNAP-ON, TWIST-OFF SAFETY CAP AND CONTAINER

[76] Inventor: Morton Stull, Split Rock Rd., Boonton Township, Morris County, N.J. 07005

[21] Appl. No.: 146,033

[22] Filed: May 2, 1980

[51] Int. Cl.[3] ..... B65D 55/02

[52] U.S. Cl. ..... 215/224; 215/217; 215/318

[58] Field of Search ..... 215/217, 224, 318, 216

[56] References Cited

U.S. PATENT DOCUMENTS

| | | | |
|---|---|---|---|
| 3,695,475 | 10/1972 | Ruekberg | 215/217 |
| 3,923,181 | 12/1975 | Libit | 215/224 |
| 3,955,696 | 5/1976 | Finke | 215/224 X |

*Primary Examiner*—George T. Hall
*Attorney, Agent, or Firm*—H. Gibner Lehmann; K. Gibner Lehmann

[57] ABSTRACT

A childproof safety screw cap and container having yieldable cap retainer means which are overcome, to effect cap removal, by a quarter-turn twist that produces a relatively large axial cap travel due to the provision of multiple screw thread elements thereon. The cap can be pushed straight on, accompanied by bypassing of the threads. The retainer means and the threads increase their interlock action if the cap is squeezed laterally, as by the act of a child applying its teeth to the cap. A shielding flange on the container defeats efforts to bite the cap under its bottom rim, and a bevelled top peripheral portion of the cap defeats its being gripped at the top, by the teeth.

12 Claims, 5 Drawing Figures

CHILDPROOF, SNAP-ON, TWIST-OFF SAFETY CAP AND CONTAINER

BACKGROUND

This invention relates to small plastic closure caps and containers therefor, and more particularly to safety closure constructions which are proof against unauthorized removal especially by children.

In the past many different cap constructions intended to accomplish the above purpose have been proposed and produced. In some of these, the reclosing of the container proved to be inconvenient, whereby the user would neglect to properly replace the cap. Therefore the safety feature was defeated, in such cases. With other constructions it was necessary for the user to effect alignment of certain reference marks, in order to remove the cap. This likewise proved to be unsatisfactory, mainly because of poor eyesight of the individual, necessity for middle-of-the-night dosages, inaccessible eyeglasses, etc. Here again, the net result was the leaving of the container unclosed, at least until proper conditions were obtained to effect the reclosing.

Still other constructions were found to be inadequate in guaranteeing against tampering by the child, and in consequence the contents of the container could be available, for possible ingestion, with undesirable results.

The above disadvantages and drawbacks of prior safety cap constructions are obviated by the present invention, which has for an object the provision of a novel and improved safety cap and container construction which greatly simplifies the opening and reclosing by adults while at the same time presenting insurmountable difficulties to children, thus making for effective safety with convenience.

One objective, then, is to provide a safety cap and container which are especially simple in construction, and economical to fabricate, while being effective for the desired purpose.

Another object of the invention is to provide an improved cap and container combination as above set forth, wherein simple well-understood and familiar operations are employed in the opening and closing procedures while at the same time a child cannot easily perform these to open the container.

A still further object of the invention is to provide an improved cap and container, which are proof against opening efforts by a child when using the teeth on the cap.

An additional object of the invention is to provide a novel cap and container construction in accordance with the foregoing, wherein a child's efforts to remove the cap using the teeth, will result in increased resistance to removal by the cap.

A feature of the invention resides in the provision of an improved cap and container combination, wherein the opening procedure can be easily and quickly learned by the authorized user.

Still another object of the invention is to provide a novel and improved cap and container as above characterized, wherein tight and effective sealing of the container contents is had, regardless of the manner of replacement of the cap after each use.

Still other features and advantages will hereinafter appear.

The above objects are accomplished by the provision of a unique combination structure of cap and container neck, each having multiple, large-pitch cooperable thread means consisting of plural elements which extend circumferentially through more than a half circle and less than a full circle. The screw cap, of resilient plastic, can be forced onto the container neck into sealing position by a straight axial push, during which the loosely fitting threads are forced past each other. Yieldable detent means on the cap and neck pick up the movement and complete it, aiding the force-on action instituted by the user. The cap and neck have cooperable sealing means or surfaces at a number of places, first at the exterior of the neck lip, and then optionally at the lip or rim itself or inside the opening of the neck. Thus, a quick and easy replacement of the cap is possible. In removing the cap, the user grasps and squeezes it laterally or radially inward. This causes a deep, driving engagement of the screw threads, whereupon by a quarter turn or less the threads force the cap axially off the neck, overcoming the restraint put on it by the detent means. The user is required to maintain the squeezing of the cap during such quarter turn to effect the removal, and children normally let go of the cap for a new grip, before the full quarter turn is carried out. In this circumstaence, the detent means of the structures come into play and return the cap automatically to its full-on position. Thus, removal by a child is thwarted. If the child resorts to gripping the cap with the teeth, the inward pressures on the sides of the cap will cause the detent means to more forcefully resist removal of the cap, and the same is true of the threads, which now become more fully or deeply engaged.

Figure 1:
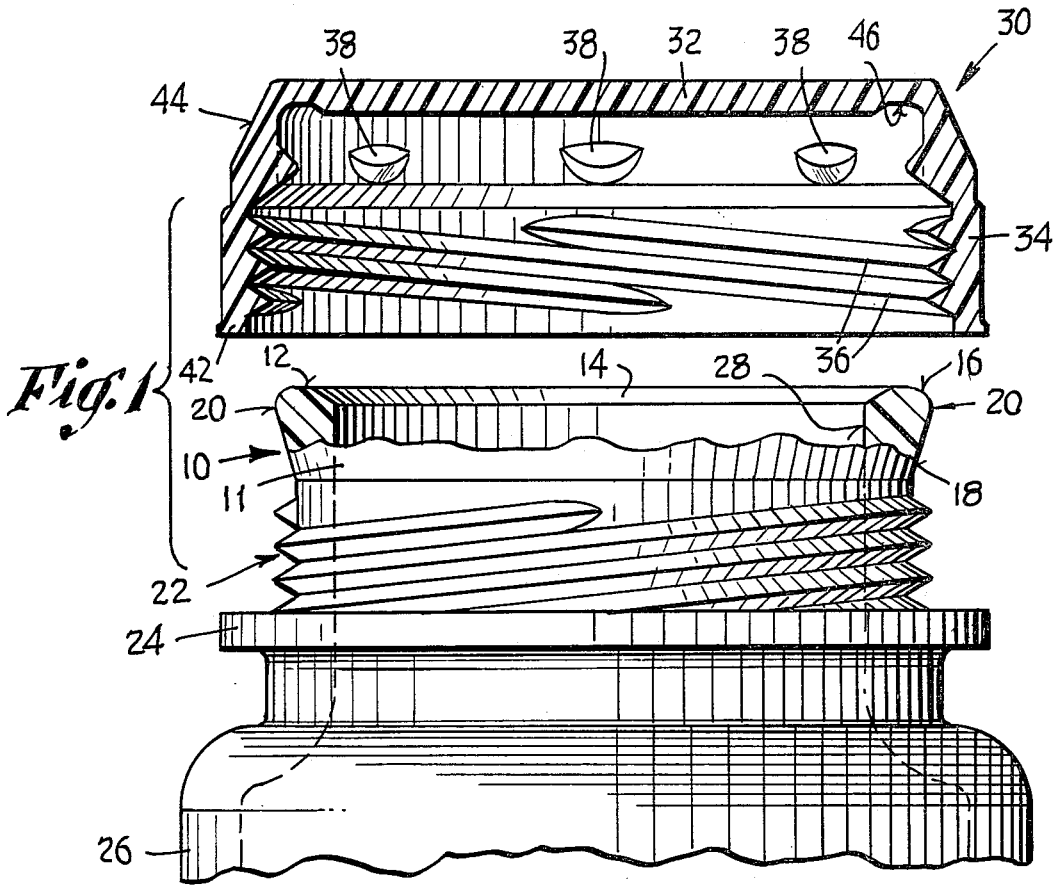
FIG. 1 is an axial, sectional view of the improved screw cap and container neck as provided by the invention, shown separated.

As shown, the improved container neck 10 as provided by the present invention comprises a cylindrical mouth portion 11 having a circular top or rim surface 12 which includes a chamfer 14 at its inner portion, and a rounded, lead-on area 16 at its exterior portion.

According to the invention, the lead-on area or surface 16 merges with an axially-extending camming surface 18, there being a juncture or sealing bead 20 between said surfaces which functions to provide a secondary seal, as will be later brought out.

Past the deep or smaller-diameter portion of the camming surface 18, the container neck 10 has a special set of multiple screw threads 22, extending close to an annular shoulder 24 which is hereinafter also referred to as a barrier flange.

The body portion of the container is indicated at 26, and is not shown in its entirety since it constitutes no part, per se, of the present invention. The inner surface or bore 28 of the container neck 10 is smooth and free of mold-parting lines since it is formed during the molding by a cylindrical plug in the die, as can be understood.

The invention provides, to be cooperable with and received on the container neck 10, a novel, resilient, plastic screw cap 30 comprising a transverse top wall 32 and a cylindrical side wall 34 which latter has a special set of internal threads 36 adapted to mate with the threads 22 of the container neck.

Disposed above the internal threads 36 of the screw cap 30 are yieldable nibs or detents 38, which in accordance with the present invention, are engageable with the camming surface 18 of the container neck and are able to cam the cap 30 to its deep position wherein it seats tightly down on the neck when assembled thereto.

In accordance with the present invention there are provided unique structures on the container neck 10 and screw cap 30, by which the cap can be applied to the neck by a straight-line, axial, push-on motion during which the cooperable threads 22, 36 are forced to bypass each other once, this being effected by yielding of the resilient material from which the cap 30 is molded, and by the number of thread elements and location of the shoulder or barrier flange 24. In conjunction with such straight-line application of the cap 30 to the container neck 10, the invention provides a camming action between the nibs or detents 38 and the camming surface 18, which causes the cap 30 to be forced fully onto the container neck, effecting a completion of the movement which is initiated by the user when the cap is first applied.

Figure 3:
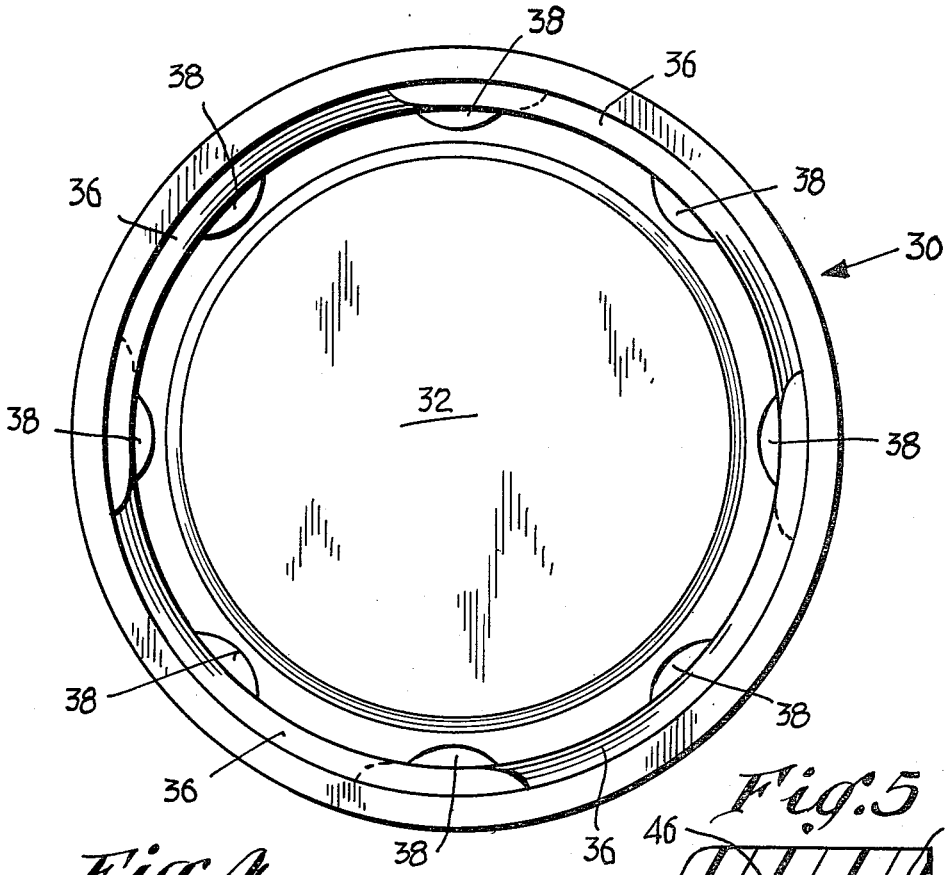
FIG. 3 is a bottom plan view of the screw cap of FIGS. 1 and 2.

Also, in accordance with the present invention, the threads 22, 36 of the container neck and cap are constituted of sets of multiple thread elements which are separate from each other in each set. The cap 30 can have four such thread elements 36, and the container neck 10 can have four thread elements 22. The four cap elements 36 are seen in FIG. 3, and each element extends circumferentially through more than a half circle and less than a full circle. This construction, in conjunction with the pitch of the threads 22, 36 is such that when the screw cap is twisted or unscrewed through a quarter turn, it will be forced off the neck sufficiently to cause the detents 38 to completely bypass the sealing bead 20 at the camming surface 18, and to ride onto the rounded lead-on surface 16, thereby now tending to continue the removing movement of the cap.

It will be noted that the detent nibs 38 thus not only tend to complete the applying movement of the cap to the container neck 10, but also to complete the removing movement of the cap from the container neck, the latter occurring in response to the aforementioned quarter-turn-twisting motion that is given to the cap 30.

The cooperable screw threads 22, 36 preferably normally loosely engage with each other, and when the user desires to remove the cap 30 the side walls are gripped and forced inwardly to apply opposing pressures so as to bring portions of the cooperable threads in deep-driving engagement with each other. The forces applied to the side walls of the screw cap will be naturally in generally opposite directions so as to deform the cap and effect the said deep engagement of the threads, which occurs at the points of pressure.

Figure 2:
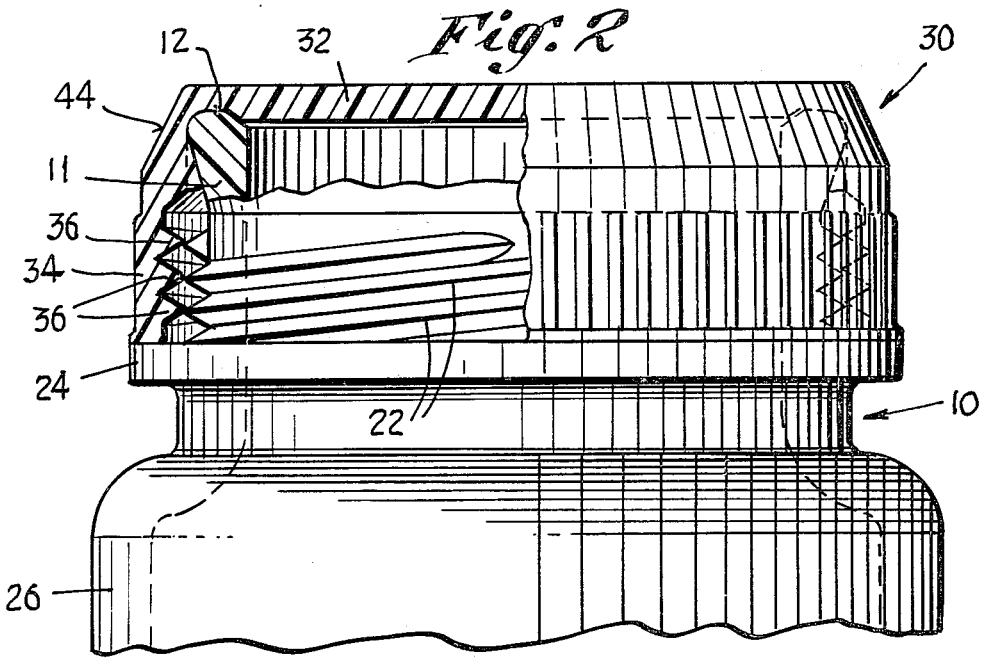
FIG. 2 is a similar view of the cap and container neck, shown with the cap applied to the neck and disposed in its sealing position.

In accordance with the present invention such action is especially effective in thwarting unauthorized efforts of a child to remove the cap. The normal removal of the cap by an adult is effected by maintaining the gripping pressures on the side walls on the cap during the full quarter-turn-twisting movement; I have found, surprisingly, that a child normally does not maintain such deforming pressure which is required to bring the threads into deep engagement. Instead, the child in virtually all cases releases the side pressure on the cap before the quarter turn has been made; in consequence, the camming action of the nibs 38 on the camming surface 18 is such that the cap will be automatically reseated in the fully-closed position. And therefore, when the child takes a second or new grasp on the cap, the latter is again in its starting position. Thus, a repetition of the futile, short-grip action ensues; each such time the cap is not removed, but instead returns to the fully-closed position of FIG. 2 when the side pressure relaxes.

Also, as provided by the invention, attempts by the child to remove the cap with the use of the teeth in biting it, will not be successful since the lower rim portion 42 of the cap normally is tightly engaged with the annular barrier flange 24, and the latter is made to be relatively rigid on the container neck. No space normally exists between the bottom rim 42 of the cap and the flange 24, to accommodate the teeth of a child. Moreover, the outer top peripheral portion of the cap is provided with a bevelled surface 44, which minimizes the likelihood of the cap being gripped by a child's teeth. If the cap is subjected to any pressure of a child's teeth, the deformation which results will cause the detent nibs 38 to force the cap more tightly on the container neck, and the same will occur with respect to the cooperable threads, since these will be forced to engage each other more deeply so as to prevent any bypassing.

Figure 4:
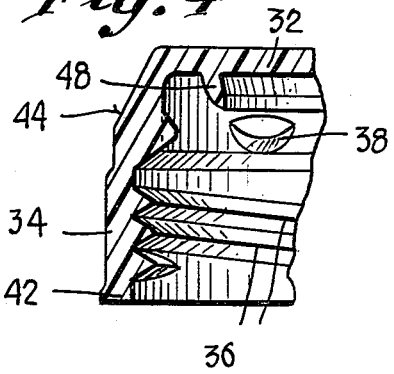
FIG. 4 is a fragmentary, sectional view of the cap, illustrating another embodiment of the invention.
Figure 5:
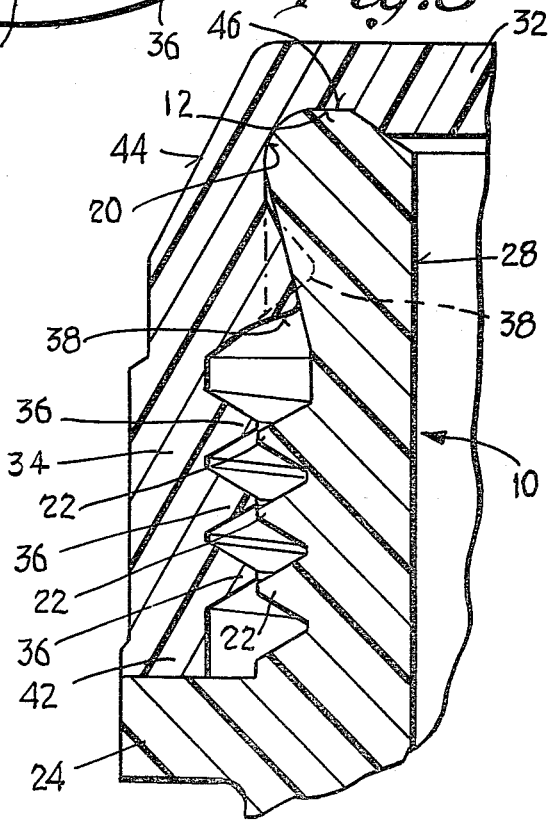
FIG. 5 is a fragmentary, axial sectional view, enlarged, of the cap and container neck assembled, showing further details of the construction.

The screw cap 30 has an inner sealing surface 46 which is engageable with the juncture surface or bead 20 of the container neck, thereby to provide the aforementioned secondary seal between the cap and the container neck. A primary seal is established between the smooth top surface 12 of the container neck and the adjoining cooperable undersurface of the cap 30. Alternatively, a seal can be established by means of an annular, resilient, depending flange 48 on the underside of the top 32 of the cap, such flange being engageable with the bevelled surface 14 of the neck rim, and becoming partially inserted in the bore 28 of the container neck. FIG. 4 shows the flange 48.

It will be now seen from the foregoing that I have provided a unique combination of resilient, plastic screw cap and container neck, which enables the screw cap to be pushed onto the neck and sealed thereto by a simple, quick, straight-line movement, and which enables the cap to be removed by gripping and squeezing it at its sides and simultaneously subjecting it to a quarter-turn in the unscrewing direction. These movements are easily carried out by an adult. The grip-sustained unscrewing movement is not natural for a child to carry out since he normally releases his grip on the side walls of the cap before the full quarter-turn is effected. This results in the cap automatically being shifted again to its fully-seated position, and defeats any action of a bypass of the nibs 38 past the juncture surface or bead 20 on the container neck, this being a necessary requisite to removal of the cap.

Subsequent grips and efforts on the part of the child will not be successful for the reason that at least a full quarter-turn is necessary to dislodge the cap from the container neck. Efforts by a child to remove the cap are basically restricted, because of the difference in the size of children's hands whereby they do not grip the cap in the same place that the adult does and thereby they do not apply pressure where it is required on the side walls in order to open the cap. The child's hand position simply causes the cap to fruitlessly rotate wherein it maintains its closure and sealing requirements. Furthermore, the closure cannot be removed by the children by biting, because of the biting barrier 24 which has been located to restrict the child's teeth from contacting the underside of the cap. The location of the bead 20 and the interferences are so designed that biting will cam the cap more tightly on the neck if the child bites the upper portion of the closure. If the child bites the lower portion of the closure, then the threads are more securely locked into each other due to the resilient nature of the closure; the tighter the bite, the more difficult it is to remove the cap.

When the closure is sealing on the neck, the threads may be in contact. This means that the OD of the thread on the bottle may be touching the threads in the cap to the extent that when the closure is rotated clockwise by gripping it at the sides, a clicking or overriding is encountered. The amount of engagement which is acceptable, cannot be enough to allow the cap to be shifted upward during counter-clockwise rotation when lateral pressure (squeeze) is not applied.

The diameter of the flange 24 should be the same diameter as the outside diameter of the cap skirt which overlies it. However, in a particularly short closure wherein there is not much distance between the retention bead 20 and the threaded area on the cap skirt, it is desirable to make the diameter of the flange 24 slightly smaller than the outside diameter of the cap skirt so that the consumer can grip the side wall at the lowest portion without encountering undue interference from the flange. Of course, if the flange is too small in diameter, the face of the closure skirt will be exposed, and if the child can easily grip the face of the side wall with the sharp edges of the teeth, removal may be possible.

The axial length of the lead-on surface 16 is restricted to a given value. This is intended to overcome any camming-off action that might occur when a child bites at the very top of the cap, at a point above the largest diameter of the sealing bead 20. It is desirable to have a slight radius at the lead-on 16 so that the closure can be easily centered for assembly to the neck, both during packaging and by the consumer during re-use.

The cap of FIGS. 1–3 and 5 is the same as the cap of FIG. 4 but with the flange 48 omitted.

Variations and modifications are possible without departing from the spirit of the invention.

I claim:

1. A childproof, push-on, quarter-turn, twist-off cap construction in a dispensing container, comprising in combination:

(a) a container neck having exterior screw thread means and having a conical camming surface, (b) a resilient screw cap having internal screw threads means cooperable with the screw thread means of the container neck, all of said screw thread means being adapted to enable the cap to be forced onto the neck under straight axial pressure which forces the screw thread means to bypass each other, (c) yieldable detent means on the screw cap, engageable and cooperable with the camming surface of the container neck, said detent means normally tending to either complete the applying movement of the screw cap or else the removing movement of the same, and (d) cooperable sealing surfaces on said container neck and screw cap, (e) the number and pitch of said screw thread means enabling them, from any given rotative position of the screw cap with respect to the container neck, to shift said screw cap off of said neck in response to substantially a quarter turn in the unscrewing direction while the cap is being deformed by opposing, radially-inward pressures thereon which are sufficient to maintain its screw thread means in a deep driving position with respect to the screw thread means of the container neck, said cap normally maintaining its screw thread means out of said deep driving position.

2. A cap construction as in claim 1, wherein:

(a) the container neck has an annular barrier flange which is juxtaposed to the bottom edge of the cap when the latter is fully seated on the container neck, (b) said barrier flange having a diameter which is essentially not appreciably smaller than the outside diameter of the cap.

3. A cap construction as in claim 1, wherein:

(a) the large-diameter portion of the camming surface of the container neck is disposed near the top of the cap when the latter is fully seated on the neck, (b) the outer, top peripheral portion of the cap being bevelled to minimize the likelihood of its being gripped by a child's teeth.

4. A cap construction as in claim 1, wherein:

(a) the cooperable sealing surfaces on the container neck and screw cap comprise a yieldable sealing skirt on the inside of the cap, adapted to be received in the opening of the container neck.

5. A cap construction as in claim 1, wherein:

(a) the cooperable sealing surfaces on the container neck and screw cap comprise the lip of the neck and an annular surface on the inside of the screw cap, engageable with said neck lip.

6. A cap construction as in claim 1, wherein:

(a) the container neck has a rounded, lead-on surface adjacent the large diameter portion of the camming surface of the neck, (b) said lead-on surface having a relatively short, axial length.

7. A cap construction as in claim 1, wherein:

(a) the screw thread means of the cap are normally out of engagement with the screw thread means of the container neck.

8. A cap construction as in claim 1, wherein:

(a) the screw thread means of the cap have a shallow engagement with the screw thread means of the container neck.

9. A cap construction as in claim 2, wherein:

(a) said barrier flange is relatively stiff and unyielding.

10. A cap construction as in claim 1, wherein:

(a) multiple, separate threads on the screw cap and container neck, constitute the said screw thread means thereof.

11. A cap construction as in claim 1, wherein:

(a) the engagement between the detent means and the camming surface of the screw cap and container neck, effects a shifting of the cap axially on the neck to a more fully seated position.

12. A cap construction as in claim 10, wherein:

(a) there are four separate threads on the container neck, and four separate threads in the screw cap.

* * * * *